US005411840A

United States Patent [19]

Texter et al.

[11] Patent Number: 5,411,840

[45] Date of Patent: May 2, 1995

[54] LOW VOLUME PROCESSING FOR ESTABLISHING BOUNDARY CONDITIONS TO CONTROL DEVELOPER DIFFUSION IN COLOR PHOTOGRAPHIC ELEMENTS

[75] Inventors: John Texter; Roland G. Willis, both of Rochester, N.Y.

[73] Assignee: Eastman Kodak Company, Rochester, N.Y.

[21] Appl. No.: 992,303

[22] Filed: Dec. 21, 1992

[51] Int. Cl.[6] ..... G03C 7/46; G03C 8/00; G03C 5/18; G03C 5/26

[52] U.S. Cl. ..... 430/380; 430/226; 430/376; 430/403; 430/405; 430/943; 430/959; 430/963

[58] Field of Search ..... 430/226, 376, 380, 403, 430/405, 943, 959, 963

[56] References Cited

U.S. PATENT DOCUMENTS

| | | | |
|---|---|---|---|
| 3,342,599 | 6/1965 | Reeves | 96/66.2 |
| 4,003,070 | 1/1977 | Merz et al. | 354/322 |
| 4,060,418 | 11/1977 | Waxman et al. | 96/29 D |
| 4,119,990 | 10/1978 | Mason et al. | 354/317 |
| 4,157,915 | 1/1979 | Hamaoka et al. | 96/55 |
| 4,327,988 | 5/1982 | Vanhorebeek et al. | 354/320 |
| 4,332,454 | 6/1982 | Hensel et al. | 354/317 |
| 4,354,755 | 10/1982 | Becheiraz | 354/322 |
| 4,371,609 | 2/1983 | Kajiwara et al. | 430/373 |
| 4,399,212 | 8/1983 | Boie et al. | 430/404 |
| 4,480,907 | 11/1984 | Vackler | 355/10 |
| 4,490,030 | 12/1984 | Acklin et al. | 354/322 |
| 4,577,949 | 3/1986 | Geyken et al. | 354/319 |
| 4,647,173 | 3/1987 | Schär | 354/319 |
| 4,736,221 | 4/1988 | Shidara | 354/317 |
| 4,868,098 | 9/1989 | Steiger et al. | 430/393 |
| 4,875,067 | 10/1989 | Kanzaki et al. | 354/322 |
| 4,945,934 | 8/1990 | Vaughan, III | 354/317 |
| 5,019,492 | 5/1991 | Buchanan et al. | 430/543 |
| 5,034,767 | 7/1991 | Netz et al. | 354/317 |
| 5,043,254 | 8/1991 | Nakagawa et al. | 430/405 |
| 5,043,756 | 8/1991 | Takabayashi et al. | 354/320 |
| 5,047,795 | 9/1991 | Keable et al. | 354/320 |
| 5,079,580 | 1/1992 | Wada | 354/299 |
| 5,166,043 | 11/1992 | De Prijcker | 430/539 |
| 5,206,128 | 4/1993 | Arai | 430/539 |
| 5,210,007 | 5/1993 | Texter et al. | 430/959 |
| 5,240,821 | 8/1993 | Texter et al. | 430/959 |
| 5,256,525 | 10/1993 | Southby et al. | 430/943 |

FOREIGN PATENT DOCUMENTS

| | | | |
|---|---|---|---|
| 4020058A1 | 2/1992 | Germany . | |
| 581140 | 1/1983 | Japan | 430/959 |
| 61-77851 | 4/1986 | Japan . | |
| 61-80149 | 4/1986 | Japan . | |
| 61-80150 | 4/1986 | Japan . | |
| 64-44938 | 2/1989 | Japan . | |

OTHER PUBLICATIONS

Schleigh et al, *Research Disclosure* 12942.

Pupo et al., *Research Disclosure* 15159, Nov. 1976, pp. 63–64.

*Primary Examiner*—Charles L. Bowers, Jr.

*Assistant Examiner*—J. Pasterczyk

*Attorney, Agent, or Firm*—Paul A. Leipold

[57] ABSTRACT

A method of forming chromogenic photographic image comprising the steps of:

providing an aqueous developable photographic element coated on a single dimensionally stable support, wherein said element comprises in reactive association (1) a developing agent, where said developing agent is a primary amine or a precursor of a primary amine, (2) radiation sensitive silver halide, (3) a color coupler compound that forms or releases a dye upon reaction with the oxidation product of a primary amine developing agent, and (4) a hydrophilic binder;

exposing said element to actinic radiation; and developing said image by contacting said element with an applied volume of an aqueous processing solution, wherein said applied volume is limited to less than 800% of the swell volume of said element in equilibrium-mechanical contact with said processing solution or the temporal duration of said contacting is limited to a time less than 500% of the time necessary for said element to swell to 90% of said swell volume.

38 Claims, No Drawings

LOW VOLUME PROCESSING FOR ESTABLISHING BOUNDARY CONDITIONS TO CONTROL DEVELOPER DIFFUSION IN COLOR PHOTOGRAPHIC ELEMENTS

FIELD OF THE INVENTION

This invention relates to photographic systems and processes for developing images in light sensitive silver halide photographic elements. More particularly this invention relates to use of low volumes of processing solutions in the development of silver halide photographic elements.

BACKGROUND OF THE INVENTION

Incorporated Developers and Developer Precursors

The incorporation of developers and developer precursors in photographic elements has been disclosed by Matejec et al. in German Offenlegungsschrift 40 20 058 A 1, by Reeves in U.S. Pat. No. 3,342,599, by Schleigh and Faul in Research Disclosure (volume 129, pp. 27–30, 1975), by Waxman and Mourning in U.S. Pat. No. 4,060,418, by Hamaoka et al. in U.S. Pat. No. 4,157,915, by Kajiwara et al. in U.S. Pat. No. 4,371,609, by Buchanan et al. in U.S. Pat. No. 5,019,492 and by Nakagawa et al. in U.S. Pat. No. 5,043,254. Matejec et al. disclose the incorporation of ballasted paraphenylenediamines in multilayer chromogenic elements. Reeves discloses the use of Schiff-base developer precursors. Schleigh and Faul describe the quaternary blocking of color developers and the acetamido blocking of paraphenylenediamines. Hamaoka et al. and Waxman and Mourning describe the preparation and use of carbamate-blocked paraphenylenediamines. Kajiwara et al. disclose the incorporation of paraphenylenediamines in photographic elements and the development of said elements using hydrogen peroxide assisted amplification. Buchanan et al. describe the preparation of $\beta$-ketoacyl-blocked paraphenylenediamines. Nakagawa et al. disclose the incorporation of ballasted $\rho$-phenylenediamines in color photographic elements to reduce processing time and to improve processing variability.

Buchanan et al. in U.S. application Ser. No. 07/810,241 filed Dec. 19, 1991 entitled *Blocked Photographically Useful Compounds for use with Peroxide-Containing Processes,* Texter et al. in U.S. application Ser. No. 07/810,322 filed Dec. 19, 1991 entitled *Image Intesification Chemistry with Blocked Incorporated Developers,* Southby ct al. in U.S. application Ser. No. 07/810,944 filed Dec. 19, 1991 entitled *Blocked Incorporated Developer in a Photographic Element,* and Texter et al. in U.S. application Ser. No. 07/810,232 filed Dec. 19, 1991 entitled *Solid Particle Dispersion Developer Precursors for Photographic Elements* disclose the advantageous incorporation of a variety of developers and developer precursors in photographic elements.

Low Volume Processing

Methods of processing photographic materials utilizing low volumes of processing solutions have been developed by numerous workers for a variety of reasons. These reasons include the desire to minimize waste from the needless use of excessive quantities of processing solution, to minimize pollution and processing solution effluent, and to promote in general the concept of "single-use" chemistry, wherein a given quantity of processing solution is metered onto the substrate (photographic element) to be processed, and thereon totally consumed and/or thereafter discarded. Other motivation includes the need to have rapid processing of photographic elements, as described by Hersh and Smith in *Photographic Science and Engineering,* volume 5, No. 1, January-February 1961, pp. 48–54. Such rapid processing systems, many of which offer low-volume attributes, may be classified according to a multi-tiered scheme as direct or indirect methods, methods using high-viscosity processing fluids and those using low-viscosity fluids, and the mode of application, including immersion, spraying, saturated and web transfer. Diffusion transfer of processing fluids is another general method suitable for applying low volumes. A rapid access low volume processor has been described by Jacobs in *Photographic Science and Engineering,* volume 1, No. 4, March 1958, pp. 156–160.

Merz and Michaelis in U.S. Pat. No. 4,003,070 disclose an apparatus comprising a pair of drums, wherein said drums define with the circumferential walls thereof a first channel section and a second channel section, and wherein a processing solution is circulated through said sections and into the interior of the respective drums, and a feeding arrangement to feed photographic material into said sections so that said material becomes treated with said processing solution. Said apparatus enables development of said materials with only a relatively small amount of treating fluid.

Boie et al. in U.S. Pat. No. 4,399,212 disclose a method for processing photographic sheet material, wherein said method comprises bring said material into surface contact with a support impregnated with the required processing chemicals in the presence of the required quantity of water.

Shidara in U.S. Pat. No. 4,736,221 discloses methods and devices for processing photographic film using atomizod liquid processing agents. A preferred process disclosed uses the application of atomized processing solution by applying ultrasonic vibration to said solution.

Steiger and Furholz in U.S. Pat. No. 4,868,098 disclose a method of processing exposed photographic materials wherein an amount of processing solution is applied to the uppermost layer of said materials where said amount corresponds to not more than the swelling volume of said materials, and thereafter said material is subjected to a heat treatment.

Vaughan in U.S. Pat. No. 4,945,934 discloses a method and apparatus for processing and transporting photographic elements in the form of sheet materials. The methods disclosed epitomize the "single-use" concept described above. A pliable web having a multiplicity of protrusions defined on at least one surface thereof is wetted with a controlled volume of processing solution and put into surface-to-surface contact with said sheet material.

Iwano in U.S. Pat. No. 4,954,425 and in Japanese Kokai Patent No. Sho 64[1989]-44938 discloses a variety of low volume processing systems for color-intensifying processing, wherein color-intensifying processing solutions may be inherently unstable due to the presence of oxidizing and reducing agents in said solutions. Said oxidizing agents may include hydrogen peroxide or a compound that releases hydrogen peroxide such as percarbonic acid or perboric acid. Said reducing agents may include any common color developing agents such as $\rho$-phenylenediamines, m-aminophenols, dye developers, and the like. These low volume processing systems include laminar flow development as described in Japanese Kokai Patent No. Sho 61[1986]-77851, coating development as described in Japanese Kokai Patent No. Sho 61[1986]-80149, spraying development as described in Japanese Kokai Patent No. Sho 61 [1986]-80150, and thin layer development.

None of the above low-volume processing references address the specific processing needs of incorporated developing agents or developing agent precursors.

In conventional processing of photographic elements, where said elements do not incorporate developer or developer precursor, the volume of developer solution that can be efficiently applied is controlled by the solubility of the developing agent in the developing solution. Such solutions typically are high in ionic strength. This solubility limitation is not a significant problem in black and white developing where the active developing agent is generally ionized and extremely water soluble at typical developer pH of 10–12. However, this solubility limitation poses a major problem in the case of color developers, such as primary amine developing agents like paraphenylenediamines, that exist at these pH as the rather insoluble free bases.

PROBLEM TO BE SOLVED BY THE INVENTION

It has not previously been recognized that known deep tank processes for forming photographic images with elements that incorporate developer and developer precursors in reactive association with silver halide in said elements suffer inefficiencies from the wasteful diffusion of developer and developer precursor out of said elements into said deep tank processing solutions. These unwanted inefficiencies include unwanted seasoning and processing variability of said solutions, low densities because of inefficient use of developer and developer precursors, loss of developer or developer precursor from the photographic element before development has occurred, pollution from developer and developer precursor effluent, and unwanted hazards from the handling of developer solutions hazardous to photofinishing personnel.

Conventional processing baths have considerable disadvantages, particularly if only one or a small quantity of film strips or paper sheets are to be processed. The baths must be individually prepared and adjusted to the correct temperature. Said baths will frequently only keep for a limited time, as in the case of developer baths, so that if the baths are used only once there is a considerable waste of material. Said baths are environmentally harmful if they are poured into sewer systems.

SUMMARY OF THE INVENTION

It is an object of the present invention to provide an improved method of forming chromogenic photographic images with silver halide containing photographic elements. It is a further object of the present invention to provide a method that reduces the amount of incorporated developer or developer precursor that is wasted by unwanted diffusion of said incorporated developer or developer precursor out of said element. Yet another object of the present invention is to provide a photographic element that has a layer structure which minimizes deleterious effects on developer washout and developer precursor washout of processing solution agitation.

These and other objects of the invention are generally accomplished by providing a method of forming a chromogenic photographic image comprising the steps of:

providing an aqueous developable photographic element coated on a single dimensionally stable support, wherein said element comprises in reactive association (1) a developing agent, where said developing agent is a primary amine or a precursor of a primary amine, (2) radiation sensitive silver halide, (3) a color coupler compound that forms or releases a dye upon reaction with the oxidation product of a primary amine developing agent, and (4) a hydrophilic binder;

exposing said element to actinic radiation; and developing said image by contacting said element with an applied volume of an aqueous processing solution, wherein said applied volume is limited to less than 800% of the swell volume of said element in equilibrium-mechanical contact with said processing solution or the temporal duration of said contacting is limited to a time less than 500% of the time necessary for said element to swell to 90% of said swell volume.

ADVANTAGEOUS EFFECT OF THE INVENTION

The method of the present invention greatly reduces the volume of activating solution needed to develop images in light sensitive silver halide layers and elements comprising such layers. Said method and the element of the present invention also greatly reduce the amount of incorporated developer or developer precursor that is wasted by the unwanted diffusion of said developer or developer precursor out of said elements during and before development of said silver halide. This reduction of waste corresponds to an increase in the dye-forming efficiency in said method and element, where "dye-forming efficiency" is defined as the amount of dye formed per unit amount of developer or developer precursor coated in said element. In this respect, the present invention solves the previously unrecognized problem of incorporated developer and developer precursor loss to large volume processing baths. Said method thereby reduces unwanted seasoning of processing solutions and increases the amount of developed density that can be achieved with a given quantity of incorporated developer or developer precursor.

DETAILED DESCRIPTION OF THE INVENTION

Two or more chemical components in a photographic element are "in reactive association" when said components can chemically interact with one another. This chemical interaction may occur when said element is wetted with processing fluid, and might not occur when said element is dry. Said interaction may occur in a dry element when said element is heated, or as the result of slow diffusion of one or more components in and through said element, even though said element is dry. However, the operative interaction may be by any chemical means or intermediary means wherein an effect on one component may be attributed to causation of said effect by another component. The phrase "in reactive association" generally refers to any two components in the same or different layers of a photographic element that may be connected by a chemical diffusion path, where said path does not exit said element.

The term "swell volume" is defined herein to mean, for a particular combination of processing solution and photographic element, the volume per unit area of processing solution imbibed into said element when said element is in contact with an excess of said solution and when said contact is in mechanical equilibrium. The term "applied volume" refers to the processing solution volume per unit area of photographic element that is applied by any of the means described or disclosed herein. Suitable means include applicator, coating, spraying, thin-film, thin-tank, and other methods described and disclosed herein. The magnitude of an "applied volume" of processing solution may be determined by calculation dividing a total volume $V_T$ by an area of photographic element in contact with $V_T$. In the case that a large tank of processing solution is contacted with a fixed area of photographic element, $V_T$ is the total volume of processing solution in said tank. Said fixed area is fixed in magnitude, but may refer to a constantly changing segment of element, as in the case where a photographic element is transported continuously through a processing tank. Alternatively, as encountered in spraying applicator and related methods, $V_T$ is the sum of all processing solution that collides with or flows over the photographic element. In applicator methods where all processing solution applied to an element remains on or in said element until evaporation or a subsequent processing step, $V_T$ is the simple total volume of processing solution applied.

The term "processing solution" means any aqueous solution that, once applied to a photographic element of the present invention, will initiate development of the silver halide of said element. Such a processing solution may be an alkaline developing solution, it may be an alkaline solution, it may be a simple solution of an activator like hydrogen peroxide or hydroxyl amine. Such a processing solution may be a developer solution; it may be an activator solution. An "activator" comprises a chemical agent that stimulates a development process by some chemical means. Typical activators comprise alkali, dinucleophiles such as hydroxyl amine or hydrogen peroxide, and water. Typical developers comprise reducing agents, water, and nucleophiles such as hydroxide or sulfite.

Suitable methods for applying said processing solution include spraying methods, atomization methods, hopper-applicator and coater-applicator methods, web-applicator methods, thin-tank and low-volume tank methods.

Spraying methods of applying activator solution in the present invention include any known method of spraying wherein the volume of said solution applied per unit area of photographic element can be suitably metered and controlled. Typical methods of spraying include the methods described by Doetzel in U.S. Pat. No. 2,158,817 and by Mayer in U.S. Pat. No. 2,404,138, where said patents are incorporated herein in their entirety by reference for all that they disclose. Suitable spraying methods include the method described by Shidara in U.S. Pat. No. 4,736,221 in column 2, lines 28–59 and in FIGS. 2A and 2B of said patent, and where said patent is incorporated herein in its entirety by reference for all that it discloses. Another suitable method of spraying a controlled amount of activator solution onto a photographic element in the method of the present invention is described in Japanese Kokai Patent No. Sho 61[1986]-80150. A particularly suitable method of spraying has been described by Smith and Townley in *Photographic Science and Engineering,* volume 7, (1959) beginning on page 55; this method utilizes the Kelvin Hughes processor, and is incorporated herein by reference. A cluster of nozzles is used in this method, wherein the rate of application of processing fluid is controlled by an electrical solenoid. Droplet size is controlled by the bore of said nozzles and by the air pressure driving the spray.

Related to spraying methods are atomization methods of applying activator solution, and in the present invention, such atomization methods include any known method of atomization wherein the volume of said solution applied per unit area of photographic element can be suitably metered and controlled. Suitable atomization methods include the methods described by Shidara in U.S. Pat. No. 4,736,221 in column 4, line 35 through column 6, line 38 and described further in FIGS. 4A–5B and 7–10B. Said atomization is induced by ultrasonication. The photographic element is preferably passed through an atomization chamber that is sealed on both sides thereof so that only the photosensitized side of said element is contacted with said activator solution. Said chamber may include means for guiding the atomized solution onto the photosensitive surface of said element. The amount of said solution contacted with said element may be controlled by varying the ultrasonic frequency and by varying the power of said ultrasonication. Said atomization method also may include means for recycling atomized activating solution previously atomized, wherein said means includes means for condensing and collecting condensate. Another suitable related method is described by Shidihara in U.S. Pat. No. 4,929,975, and is incorporated herein in its entirety by reference.

Hopper-applicator and coater-applicator methods of applying activator solution in the present invention include any known method of hopper coating wherein the volume of said solution applied per unit area of photographic element can be suitably metered and controlled. Suitable hopper-coating methods include the methods described by Columbus and Palmer in U.S. patent application Ser. No. 07/735,577 filed Jul. 25, 1991 and incorporated herein in its entirety by reference for all that it discloses. Preferred methods include coaters that repeatedly and intermittently apply a uniform and small volume of activator solution onto the photosensitive side of the photographic element of the present invention wherein the rate of solution application does not exceed the maximum swell rate of the hydrophilic binder layers on the photosensitive side of said element. This preferred method leaves no liquid effluent. The coater features a delivery channel leading from a manifold chamber to a slit orifice, the channel being improved in that it contains a plurality of spaced-apart wall portions connecting the opposed flow surfaces of the delivery channel, that extend in a direction towards the slit orifice, and structure inside the orifice for coalescing the individual streams fed by these wall portions, into a continuous strip of liquid to be dispensed by the slit orifice. Another preferred method of coating a controlled amount of activator solution onto a photographic element in the method of the present invention is described in Japanese Kokai Patent No. Sho 61[1986]-80149.

A web-applicator method suitable according to the present invention for the application of processing fluid to photographic elements has been described by Schreck in *Photographic Science and Engineering,* volume 4, 1960, beginning on p. 298, and by Hersh and Smith in *Photographic Science and Engineering,* volume 5, No. 1, January-February 1961, on pp. 50–51, incorporated herein by reference. This web-applicator method uses a saturated web comprising a suitable absorbent mat or web material acting as an intermediate carrier for the activator or developer. Said web comprises very short fibers of extremely small diameter (0.5–1 μm) bonded to a nonporous film base. Said web is presaturated with processing fluid and subsequently brought into surface-to-surface contact with a photographic element. The time of said contact may be varied, depending on the swell time of the hydrophilic binder typically contained in said elements, the composition of said activator, temperature, etc.

A porous-plate applicator method suitable for the application of processing fluid to photographic elements according to the present invention has been described by Hersh and Smith in *Photographic Science and Engineering,* volume 5, No. 1, January-February 1961, on page 51 and is incorporated herein by reference.

Another very useful coater-applicator or web-applicator method for the present invention is described by Vaughan in U.S. Pat. No. 4,945,934, the disclosure of which is incorporated herein by reference in its entirety. The activator solution is pumped to a hopper which wets a pliable web having defined on one of its surfaces a plurality of protrusions which define interconnected fluid reservoirs and distribution channels, and which are in surface-to-surface contact with the photosensitive side of the photographic elements of the present invention. Activator solution is transferred from said web to said element during the time said web and element are contacted under opposing web transport conditions. Typically, said element is transported past a stationary web.

Suitable coater-applicator methods for the present invention also include those methods described and cited by Dieterie and Barbee in section XV-A of Research Disclosure No. 17643, page 27, December 1978, published by Industrial Opportunities Ltd., Homewell, Havant, Hampshire, England PO9 1EF. These methods include immersion or dip coating, roller coating, reverse roll coating, air knife coating, doctor blade coating, gravure coating, spray coating, extrusion coating, bead coating, stretch-flow coating, and curtain coating. Typical coating methods suitable for use in the present invention are described by Bequin in U.S. Pat. No. 2,681,294, by Beck in U.S. Pat. No. 2,815,307, by Tyler et al. in U.S. Pat. No. 2,956,494, by Takats in U.S. Pat. No. 3,081,687, by Greiller in U.S. Pat. No. 3,632,374, by Alderman and Stievenart in U.S. Pat. No. 3,641,911, by Mason and Osman in U.S. Pat. No. 4,119,990, by Hensel et al. in U.S. Pat. No. 4,332,454, by Vackler. in U.S. Pat. No. 4,480,907, by Geyken et al. in U.S. Pat. No. 4,577,949, by Kanzaki and Ohba in U.S. Pat. No. 4,875,067, by Keable and Bostic in U.S. Pat. No. 5,047,795, and by Wada in U.S. Pat. No. 5,079,580, the disclosures of which are incorporated herein by reference in their entirety.

Thin-tank methods of applying activator solution in the present invention include any known method of applying activator solution to the photosensitive side of a photographic element wherein the volume of said solution applied per unit area of photographic element can be suitably metered and controlled. Suitable thin-tank methods include the methods described by Iwano in Japanese Kokai Patent No. Sho 64[1989]-44938 (Feb. 17, 1989) and in U.S. Pat. No. 4,954,425, the entire disclosures of which are incorporated herein by reference. Other suitable thin-tank methods include the methods described by Vanhorebeek et al. in U.S. Pat. No. 4,327,988, by Becheiraz in U.S. Pat. No. 4,354,755, by Acklin and Rossier in U.S. Pat. No. 4,490,030, by Schar in U.S. Pat. No. 4,647,173, and by Takabayashi et al. in U.S. Pat. No. 5,043,756, the disclosures of which are incorporated herein by reference. Activator solution is applied to the photosensitive side of the element of the present invention to a thickness of 1–2 mm. Related laminar flow methods such as described in Japanese Kokai Patent No. Sho 61[1986]-77851 are particularly useful in the method of the present invention. In one such method, a quantity of activator solution is contacted with the photosensitive side of an element of the present invention so that said solution will flow in a laminar fashion or that said solution will remain stationary. Such use is essentially a single-use of said quantity. This contacting can, for example, be done in the space between concentric revolving drums, wherein the photosensitive element is attached to the inner surface of the outer drum, such that the photosensitive side faces the inner drum and a small space exists between said element and the outer surface of said inner drum. Another suitable thin-tank method of applying processing fluid according to the present invention is described by Hersh and Smith in *Photographic Science and Engineering,* volume 5, No. 1, January-February 1961, p. 49, right column, and FIG. 3 therein, and incorporated herein by reference, where fluid cells or chambers may be used to contain processing fluids for direct application to photographic elements. Pressurized air and vacuum are applied to contact the emulsion side of said elements with a processing fluid for a desired contact time, usually on the order of a few seconds.

A thin-film method of processing suitable for the present invention has been described by Orlando in U.S. Pat. No. 2,856,829 and in *Photographic Science and Engineering,* volume 2, beginning on page 142; these references are incorporated herein by reference for all that they disclose. In this method, the processing fluid is drawn from a reservoir across the photographic element by a vacuum. The processing chamber is sufficiently shallow so as to allow only a thin film of fluid between a wall of said chamber and said element.

A thin-film method utilizing a porous roller-applicator of processing suitable for the present invention has been described by Seymour in *Photographic Science and Engineering,* volume 2, 1958, beginning on page 50, and is incorporated herein by reference. The use of nonporous roller-applicators as described by Hersh and Smith in *Photographic Science and Engineering,* volume 5, No. 1, January-February 1961, pp. 51–52 and incorporated herein by reference is also suitable for the present invention as a method of applying processing fluid to photographic elements.

Another thin-film method of processing suitable for the present invention has been described by Hersh and Smith in *Photographic Science and Engineering,* volume 5, on page 50, wherein the activator or developer is applied in the form of a viscous solution; this method is incorporated herein by reference. The residue from such application may be removed subsequent to processing or may be allowed to remain and dry on the element. Other methods of applying viscous processing solutions suitable for the present invention wherein belts and foils are used in modified web-applicator methods have also been described by Hersh and Smith in *Photographic Science and Engineering,* volume 5, on page 52, and are incorporated herein by reference. Another suitable method for applying a viscous processing solution is described by Netz et al. in U.S. Pat. No. 5,034,767, the disclosure of which is incorporated herein in its entirety by reference. Various processing solutions are suitably applied by extrusion coaters. Viscous processing solutions are preferably limited in applied volume by passing an element of the methods of the present invention through gapped rollers, wherein said gapped rollers control the coverage of said viscous processing solution on elements of the methods of the present invention. An auxiliary cover sheet or second dimensionally stable support may be laminated over an element of the methods of the present invention for the purpose of controlling evaporation or for the purpose of limiting the applied volume of processing solution in contact with said element. Preferred methods of the present invention do not utilize such a cover sheet or a second dimensionally stable support, because it is advantageous to keep the methods of the present invention simple and unencumbered by lamination and delamination steps attendant to the use of such auxiliary cover sheets and second dimensionally stable supports.

Suitable methods of the invention for applying processing solution to the photographic elements provided in the present invention are constrained in at least one of two alternative ways. One of these constraints involves limiting the applied volume of processing solution. The other of these constraints involves limiting the temporal duration of contact of photographic elements of the methods of the present invention with processing solution. These constraints or limitations are intended to limit the amount of processing solution that can be imbibed in and carried on the photographic elements of the methods of the present invention during the development interval for said elements with the processing solution applied. The purpose of these limitations is to minimize waste of processing solution, and is to provide boundary control of developer diffusion and developer precursor diffusion in the elements and the methods of the present invention. The advantages of these limitations have been described earlier in the present specification. The magnitude of these limitations is governed by properties of the particular combination of given photographic element and processing solution. For example, the amount of a given processing solution that can be imbibed at mechanical equilibrium into a given photographic element of the present invention will depend on a variety of parameters such as temperature, ionic strength of said processing solution, the degree of cross-linking in the hydrophilic binder of said element, etc. However, for any such combination of element, processing fluid, and temperature, the swell volume can be determined easily by means well known in the art. A particularly simple method of determining swell volume is by gravimetry. A sample of photographic element of approximately 50 $cm^2$ area is conveniently weighed while dry. Said sample is then equilibrated in excess processing solution. Said sample is then placed between two glass plates and passed through pinch rollers to remove solution external to the swollen binder. Said sample is then weighed, and the difference in weights indicates the weight of processing solution imbibed at equilibrium swell. Division of this weight by the density of the processing solution then gives the swell volume for the approximately 50 $cm^2$ sample.

In the methods of the present invention, a suitable limitation on the applied volume of processing solution is selected to be less than 800% of the swell volume of elements of the present invention. This selection was made to provide a firm limitation on the extent to which incorporated developer or developer precursor agents of the present invention could diffuse out of the swollen binder in said elements. Since excess processing solution not immediately imbibed in said element cannot undergo mass exchange with a larger solution bath to any significant degree, any developer or developer precursor of the elements and methods of the present invention that do diffuse out of the swollen layer will accumulate in this excess fluid on the surface of said elements. This excess fluid can be defined as a surface boundary layer of processing fluid. As said developer or developer precursor accumulates, the concomitant concentration increase in said boundary layer of said developer or developer precursor causes the gradient in said concentration normal to said element, at the swollen element-boundary layer interface, to decrease. This decrease causes said diffusion out of said swollen layer to decrease, and said diffusion is thereby limited and constrained.

It is preferred that the applied volume of processing solution in the methods of the present invention be less than 300% of the swell volume of elements of the present invention. This preferred limitation is advantageous because less processing solution is needed. It is particularly preferred that the applied volume of processing solution in the methods of the present invention be less than 115% of the swell volume of elements of the present invention. This particularly preferred limitation is advantageous because it further reduces the amount of processing solution is needed and practically eliminates the possibility of any significant flow being induced in the boundary layer, relative to the swollen binder, by gravitational or centripetal forces acting on the boundary layer and having components perpendicular to an interface normal, where said interface is the outer surface of said swollen binder. In the presence of a boundary layer, this interface is the swollen binder—boundary layer interface.

Other suitable methods of the present invention limit the temporal duration of contact between elements of the present invention and processing solutions to a time less than 500% of the time necessary for said element to swell to 90% of the corresponding swell volume. This limitation minimizes the contact time of said elements and a processing solution reservoir or bath, and thereby limits the extent to which developers or developer precursors of the elements of the methods of the present invention can diffuse out of said elements and into said reservoirs. Such a 90% reference point may be obtained experimentally for any particular combination of processing solution and element of the methods of the present invention. Suitable experimental methods of experimentally determining the time necessary for a photographic element comprising hydrophilic binder to swell to 90% of the corresponding swell volume have been demonstrated and described by Flynn and Levine in *Photographic Science and Engineering* in 1964, volume 8, beginning on page 275 and by Chen in *Photographic Science and Engineering* in 1972, volume 16, beginning on page 453, and are incorporated herein by reference. It is preferred that said temporal duration be less than 200% of the time necessary for said element to swell to 90% of the corresponding swell volume, because the amount of excess processing solution that can be carried as a boundary layer is thereby severely limited. It is particularly preferred that said temporal duration be less than 110% of the time necessary for said element to swell to 90% of the corresponding swell volume, because the practical absence of any excess processing solution that can be carried as a boundary layer is thereby nearly assured.

The chromogenic photographic elements of the present invention may be of any known type, so long as said elements contain radiation sensitive silver halide and an incorporated developer or developer precursor in reactive association with one another. Particularly preferred elements of the present invention contain, in addition to said silver halide and incorporated developer or incorporated developer precursor, one or more overcoat layers devoid of said silver halide and devoid of said incorporated developer or incorporated developer precursor. Said overcoat layers serve an important function in contributing to the boundary control of developer diffusion. We have made the surprising discovery that said overcoat layers, when coated at a thickness in hydrophilic binder, preferably gelatin, corresponding to about 3 $g/m^2$ or greater, establish a de facto quiescent boundary layer that retards any washout diffusional flux of developer or developer precursor during the development of said element, when said element is processed by contacting said element to a large volume processing bath. It is preferred that said thickness in hydrophilic binder be 10 $g/m^2$ or greater, since such a thickness provides even more robust boundary layer control in baths that have considerable agitation.

The incorporated developers and incorporated developer precursors of the present invention may be of any type known in the art. Suitable developers for use in the method of the present invention include dihydroxybenzenes, aminophenols, paraphenylenediamines, and pyrazolidinones. Said developing agents are preferably selected from the group comprising 4-amino-N,N-diethylaniline hydrochloride; 4-amino-3-methyl-N,N-diethyl aniline; 4-amino-3-methyl-N-ethyl-N-(β-methanesulfonamidoethyl)aniline; 4-amino-3-methyl-N-ethyl-N-(β-hydroxyethyl)aniline; 4-amino-3-(β-methane sulfonamido)ethyl-N,N-diethylaniline; 4-amino-3-methyl-N-ethyl-N-(β-methanesulfonamidoethyl)aniline; and 4-amino-3-methyl-N-ethyl-N-(2-methoxyethyl)aniline.

Suitable developer precursors for use in the method of the present invention include those compounds disclosed by Texter et at. in U.S. application Ser. No. 07/810,232 filed Dec. 19, 1991 and incorporated herein in its entirety by reference for all that it discloses and those compounds disclosed by Southby et al. in U.S. application Ser. No. 07/810,944 filed Dec. 19, 1991 and incorporated herein in its entirety by reference for all that it discloses. In particular, said suitable compounds include compounds 1–53 disclosed in Tables I–III on pages 11–18 of U.S. application Ser. No. 07/810,232 and on pages 9–16 of U.S. application Ser. No. 07/810,944. Preferred developer precursors have the structure according to formula (I):

$$CD-(T)_m-S \qquad (I)$$

in which CD is a silver halide developer of the primary amine type, T is a timing group, m is an integer from 0 to 6 and denotes the number of timing groups connected in series, and S is a blocking group. The blocking group S must have appropriate hydrolysis kinetics in that it must be a group that completely unblocks in the course of the development process. Preferred blocking groups S are acyl groups, particularly a β-ketoacyl group as described in U.S. Pat. No. 5,019,492, the disclosure of which is incorporated herein by reference, or a simple acyl ester as described in U.S. application Ser. No. 07/810,241 of Buchanan et al. filed Dec. 19, 1991 and incorporated herein by reference for all that it discloses. In formula (I), the timing group(s), T, may contain one or more substituents to control the aqueous solubility of the developer precursor. Exemplary timing groups are disclosed in U.S. Pat. Nos. 4,248,962, 4,741,994, 4,772,537, 4,985,336, and 5,019,492, the disclosures of which are incorporated herein by reference. Up to six timing groups can be joined sequentially in the method and element of the present invention, and m is preferably 0, 1, or 2. Examples of such preferred developer precursors are illustrated in Table 3.

The incorporated developer and incorporated developer precursor of the present invention are incorporated at levels suitable for obtaining the dye-densities and image

TABLE 3

Examples of Developer Precursors

DP-1

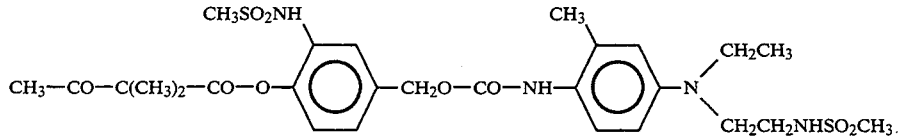

DP-2

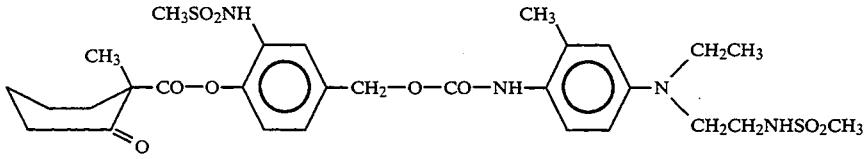

DP-3

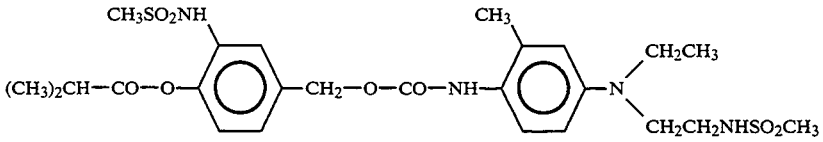

TABLE 3-continued

Examples of Developer Precursors

DP-4

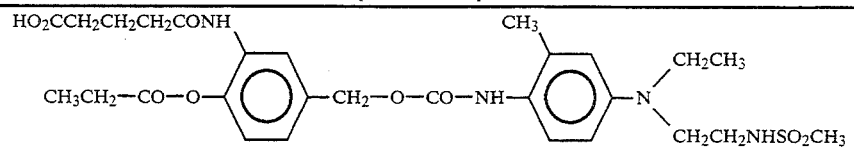

DP-5

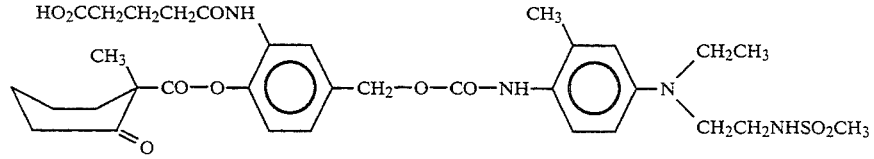

DP-6

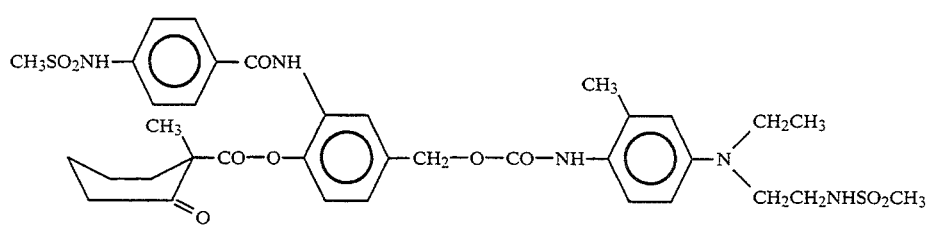

DP-7

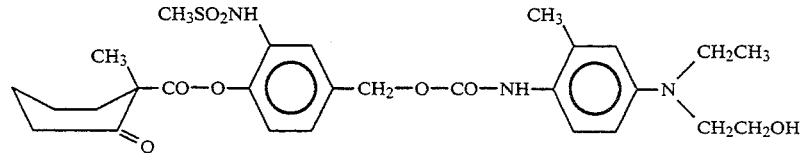

DP-8

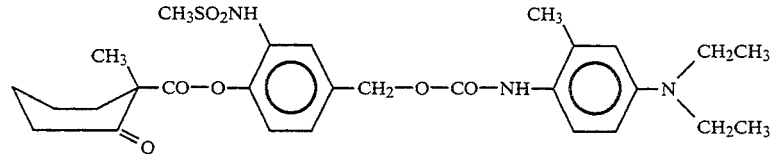

structure desired in any particular combination of element and process. Suitable levels of said incorporation are in the range of 0.1–5 mole developer or developer precursor per mole of incorporated silver halide. A range of 0.4–1 mole developer or developer precursor per mole of incorporated silver halide is preferred when maximum dye-forming efficiency is desired and granularity suppression is not a concern.

Processing solutions of the present invention comprise at least two components, wherein one component is water, and at least one additional component is present at a molar concentration in excess of $10^{-6}$ moles per liter. Processing solutions of the method of the present invention may be any known aqueous solution that activates and causes the initiation of development of silver halide contained in elements of the present invention. Typical processing solutions may be any known aqueous solution containing a reducing agent; preferred reducing agents are those described earlier: 4-amino-N,N-diethylaniline hydrochloride; 4-amino-3-methyl-N,N-diethyl aniline hydrochloride; 4-amino-3-methyl-N-ethyl-N-(β-methanesulfonamido-ethyl)aniline sulfate hydrate; 4-amino-3-methyl-N-ethyl-N-(β-hydroxyethyl)aniline sulfate; 4-amino-3-(β-methane sulfonamido)ethyl-N,N-diethylaniline hydrochloride; 4-amino-3-methyl-N-ethyl-N-(β-methanesulfonamido-ethyl)aniline sesquisulfate monohydrate; and 4-amino-3-methyl-N-ethyl-N-(2-methoxyethyl)aniline di-ρ-toluenesulfonic acid.

Said processing solutions preferably are aqueous solutions. Suitable processing solutions contain alkali hydroxides or other basic compounds that yield alkaline pH. Preferred pH of said processing solutions, when said solutions comprise hydroxides or other bases, is in the range of 8–14, and most preferably in the range of 9–12.

Said processing solutions of the methods of the present invention also typically contain nucleophiles such as sulfite, sulfate, and hydroxide, and preferably contain, when the element of the present invention contains developer precursors according to formula (I), dinucleophiles. Suitable dinucleophiles for the method of the present invention are described in U.S. Pat. No. 5,019,492 and by Texter et al. in U.S. application Ser. No. 07/810,322 filed Dec. 19, 1992 and incorporated herein in its entirety by reference for all that it discloses. Preferred dinucleophiles are those described according to formula (I) of U.S. application Ser. No. 07/810,322 on page 5 line 20 through page 6, line 7 therein. Hydrogen peroxide, hydroxyl amine, and α-amino acetic acid are examples of preferred dinucleophiles.

Suitable processing solutions of the methods of the present invention have viscosities less than 50 cP to enable smooth and rapid application by the applicator methods of the present invention. It is preferred that the processing solutions of the methods of the present invention have viscosities less than 10 cP to enable even more rapid application.

Dispersions of any of the photographically useful compounds incorporated in the elements of the present invention may be obtained by any of the methods for imparting mechanical shear well known in the art, such as those methods described in U.S. Pat. Nos. 2,581,414 and 2,855,156 and in Canadian Patent No. 1,105,761, the disclosures of which are incorporated herein by reference. These methods include solid-particle milling methods such as Ball-milling, pebble-milling, roller-milling, sand-milling, bead-milling, dyno-milling, Masap-milling, and media-milling. These methods further include colloid milling, milling in an attriter, dispersing with ultrasonic energy, and high speed agitation (as disclosed by Onishi et al. in U.S. Pat. No. 4,474,872 and incorporated herein by reference). Ball-milling, roller-milling, media-milling, and milling in an attriter are preferred milling methods because of their ease of operation, cleanup, and reproducibility.

Alternatively, dispersions wherein said photographically useful compound is present in an amorphous physical state may be prepared by well known methods including colloid milling, homogenization, high speed stirring, and sonication methods.

In the following discussion of suitable materials for use in the emulsions and elements according to the invention, reference will be made to *Research Disclosure,* December 1989, Item 308119, published by Kenneth Mason Publications Ltd., Emsworth, Hampshire P010 7DQ, U.K., the disclosures of which are incorporated in their entireties herein by reference. This publication will be identified hereafter as "Research Disclosure".

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements according to the invention can be coated on the selected supports as described in Research Disclosure Section XVII and the references cited therein.

The radiation-sensitive layer of a photographic element according to the invention can contain any of the known radiation-sensitive materials, such as silver halide, or other light sensitive silver salts. Silver halide is preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Emulsions containing more than 70 mole percent silver chloride are preferred because they are susceptible to rapid processing methods and speedy development processes. Emulsions containing more than 95 mole percent silver chloride are most preferred because they are most susceptible to rapid processing methods and speedy development processes.

The silver halide emulsions employed in the elements according to the invention can be either negative-working or positive-working. Suitable emulsions and their preparation are described in Research Disclosure Sections I and II and the publications cited therein.

Also useful are tabular grain silver halide emulsions. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520. Suitable vehicles for the emulsion layers and other layers of elements according to the invention am described in Research Disclosure Section IX and the publications cited therein. The radiation-sensitive materials described above can be sensitized to a particular wavelength range of radiation, such as the red, blue, or green portions of the visible spectrum or to other wavelength ranges, such as ultraviolet infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in Research Disclosure Section IV and the publications cited therein.

Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan color-forming coupler associated therewith. Color photographic elements and color-forming couplers are well-known in the art. The elements according to the invention can include couplers as described in Research Disclosure Section VII, paragraphs D, E, F and G and the publications cited therein. These couplers can be incorporated in the elements and emulsions as described in Research Disclosure Section VII, paragraph C and the publications cited therein.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), base compounds and base-releasing compounds such as described, for example, in U.S. Pat. Nos. 4,741,997 and 4,740,445 and in European Patent publication 210 660, the disclosures of which are incorporated herein by reference, and other additives and layers known in the art. When processing and activator solutions are used in the methods of the present invention, wherein said solutions are alkaline, it is preferred that elements of the present invention are devoid of incorporated base or base-releasing compounds, because said elements have greater storage stability. Typical elements of the present invention may contain incorporated base or base-releasing compounds when it is disadvantageous to incorporate all needed alkali in the requisite processing solution.

Photographic elements according to the invention can be exposed to actinic radiation, typically in the visible region of the spectrum to form a latent image as described in Research Disclosure Section XVIII, and then processed to form a visible dye image as described in Research Disclosure Section XIX. Processing can be any type of known photographic processing, although it is typically carried out at alkaline pH, preferably at pH 8–14, and more preferably at pH 9–12.

A negative image can be developed by using one or more of the aforementioned nucleophiles. A positive image can be developed by first developing with a non-chromogenic developer, then uniformly fogging the element, and then developing by a process employing one or more of the aforementioned nucleophiles.

Development may be followed by the conventional steps of bleaching, fixing, or bleach-fixing, to remove silver and silver halide, washing, and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The advantages of the present invention will become more apparent by reading the following examples. The scope of the present invention is by no means limited by these examples, however.

EXAMPLES

The effects of a diffusive overcoat in the layer structure and the effects of agitation during application of activator solution on developer/developer-precursor diffusion were examined experimentally. Two test coatings were made on a reflection support (titania-pigmented high-density polyethylene extruded onto paper base) according to Layer Structures 1 and 2 illustrated in Table 4. Hardener, in the form of 1,1'-[methylenebis(-sulfonyl)]bisethene was added at a level of 1.5% (w/w) of total gelatin to crosslink the gelatin. The cyan dye-forming coupler C-1 was dispersed with di-n-butyl phthalate (KS) at a weight ratio of about 1:½ by homogenization methods well known in the art. The developer precursor, DP-1, was prepared as a colloid milled dispersion by emulsifying an ethyl acetate solution of DP-1 with aqueous gelatin and dispersing aid, DA-1, and thereafter removing the ethyl acetate. A red sensitized AgCl emulsion was used as the light sensitive element. These coatings were given stepped exposures and placed in an excess of activator solution (deep tank) without agitation for 90 seconds. The aqueous activator solution comprised potassium carbonate (50 g/L) adjusted to pH 11 and 0.6% (by weight)

TABLE 4

Layer Structures in Coatings 1 and 2

| Layer Structure 1<br>Coating 1 | Layer Structure 2<br>Coating 2 |
|---|---|
| 320 mg/m$^2$ Ag<br>(as red sensitive AgCl)<br>860 mg/m$^2$ C-1<br>860 mg/m$^2$ DP-1<br>3.22 g/m$^2$ gelatin | 3.22 g/m$^2$ gelatin |
| 3.22 g/m$^2$ gelatin | 320 mg/m$^2$ Ag<br>(as red sensitive AgCl)<br>860 mg/m$^2$ C-1<br>860 mg/m$^2$ DP-1<br>3.22 g/m$^2$ gelatin |
| reflection support | reflection support |

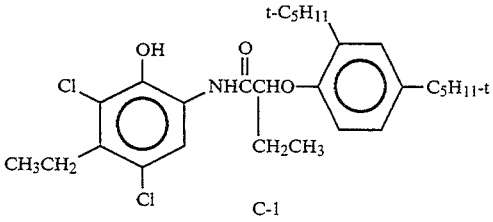

C-1

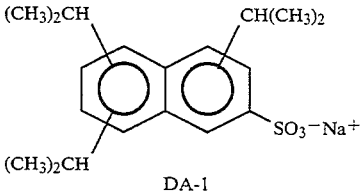

DA-1 hydrogen peroxide. After development, these coatings were placed in a bleach-fix solution, washed, dried, and read by reflectance densitometry. The Dmax obtained are illustrated in Table 5 for Coatings 1 and 2 (Examples 1 and 2, respectively). The higher Dmax in Example 2 of the present Invention process shows that overcoats not containing incorporated developer or developer precursor provide better utilization of incorporated developer or developer precursor.

TABLE 5

Impact of Protective Layer on Developer Diffusion and Dmax

| Layer Structure | Dmax |
|---|---|
| Control Structure (Example 1) | 1.22 |
| Structure of Invention Process (Example 2) | 1.39 |

The effects of boundary value control of developer or developer precursor activity at the processing solution/photographic element boundary are illustrated for Coating 2 in Examples 3–5, where the same pH 11 hydrogen peroxide activator was used for 90 seconds, and the same bleach-fix, wash, and dry sequence of steps applied in Examples 1 and 2 was used. In Example 3, the exposed coating was placed in a deep tank containing an excess of activator solution (about 9 liters) under constant nitrogen burst agitation. In Example 4, the exposed coating was placed in a deep tank containing about 250 mL of activator solution, and no agitation of the quiescent solution was made by any means other than that arising from sliding the exposed strip into the activator. The applied volume in Examples 3 and 4 was about 250 mL÷106.7 cm$^2$ (area of processed coatings), or about 23.4×10$^3$ mL/m$^2$. The swell volume for the coatings of examples 3–5 was determined to be about 14.4 mL/m$^2$. Hence the applied volume for Examples 3 and 4 was about 163,000% of the swell volume, far outside of the limitations of the methods of the present invention. Example 5 illustrates one of the preferred methods of the present invention, where a thin activator coating of approximately 43 mL/m$^2$ was applied to the test Coating 2 at about 30° C. using a hopper coating method as described in U.S. application Ser. No. 07/735,577. In Example 5, the applied volume was only about 299% of the swell volume, well inside the range of applied volumes (800% of swell volume corresponds to about 115 mL/m$^2$ for the coating and processing solution of the present example) in the methods of the present invention. In Example 3 where agitated deep-tank activation was used, most of the developer or developer-precursor diffused out of the photographic element, and only a relatively small Dmax of 0.32 was obtained. An effectively small concentration of developer and developer-precursor was maintained at the element-solution boundary, and this boundary condition resulted in a maximum diffusion gradient of said developer compounds out of the element and into the large volume of activator solution. In Example 4, where the same deep-tank was used as in Example 3, another strip of Coating 2 was processed identically, except that there was no nitrogen burst agitation. Said strip was placed into a quiescent solution, and not further agitated during the 90 sec processing interval. As shown in Table 6, a Dmax of 1.36 was obtained. Since there was no solution agitation, the concentration of said developer compounds was not maintained at the lowest possible level, and said concentration decreased in a diffusion controlled manner into the activator solution. Since the higher concentrations at the element-solution interface resulted in lower diffusion gradients, the diffusion of said developer compounds out of said element was considerably slower (than in Example 3) and resulted in more efficient utilization of said developer compounds in dye formation. In Example 5, where the activator solution was applied in a limited and metered manner by a coating operation, most of the applied activator solution swelled the layers of said element, so there was no means by which said developer compounds could diffuse out of said element (effectively the case of zero-flux boundary conditions). As is tabulated in Table 6, a Dmax of 2.62 was obtained under these more favorable conditions of our invention process.

TABLE 6

Effects of Boundary Conditions on Densitometry

| Activator Application Method | Dmax |
|---|---|
| Control Process 1 (Example 3; Agitated Deep Tank) | 0.32 |
| Control Process 2 (Example 4; Deep Tank Without Agitation) | 1.36 |
| Invention Process (Example 5; Hopper Coating) | 2.62 |

Numerous modifications and variations of this invention are possible in view of the above disclosure. It is therefore understood that within the scope of the claims appended hereto, the invention may be carried out using all suitable modifications falling within said scope.

What is claimed is:

1. A method of forming a chromogenic photographic image comprising the steps of:

providing an aqueous developable photographic element coated on a single dimensionally stable support, wherein said element comprises in reactive association (1) a developing agent, where said developing agent is a primary amine or a precursor of a primary amine, (2) radiation sensitive silver halide, (3) a color coupler compound that forms or releases a dye upon reaction with the oxidation product of a primary amine developing agent, and (4) a hydrophilic binder;

exposing said element to actinic radiation; and developing said image by contacting said element with an applied volume of an aqueous processing solution, wherein said applied volume is limited to less than 800% of the swell volume of said element; and wherein said aqueous processing solution consists of water and at least one additional component at a concentration in excess of $10^{-6}$ moles per liter.

2. A method as in claim 1, wherein said applied volume is limited to less than 300% of the swell volume of said element.

3. A method as in claim 1, wherein said applied volume is limited to less than 115% of the swell volume of said element.

4. A method as in claim 1, wherein the temporal duration of said contacting is limited to a time less than 200% of the time necessary for said element to swell to 90% of said swell volume.

5. A method as in claim 1, wherein the temporal duration of said contacting is limited to a time less than 110% of the time necessary for said element to swell to 90% of said swell volume.

6. A method as in claim 1, wherein said silver halide comprises greater than 70 mole percent silver chloride.

7. A method as in claim 1, wherein said silver halide comprises greater than 95 mole percent silver chloride.

8. A method as in claim 1, wherein said developing agent is a primary amine comprising an aminophenol or a paraphenylenediamine derivative.

9. A method as in claim 1, wherein said developing agent is selected from the group consisting of 4-amino-N,N-diethylaniline hydrochloride; 4-amino-3-methyl-N,N-diethyl aniline; 4-amino-3-methyl-Noethyl-N-(β-methanesulfonamidoethyl) aniline; 4-amino-3-methyl-N-ethyl-N-(β-hydroxyethyl)aniline; 4-amino-3-(β-methanesulfonamido) ethyl-N,N-diethylaniline; 4-amino-3-methyl-N-ethyl-N-(β-methanesulfonamido-ethyl) aniline; and 4-amino-3-methyl-N-ethyl-N-(2-methoxyethyl)aniline.

10. A method as in claim 1, wherein said developer agent is a precursor having a structure according to formula (I):

$$CD—(T)_m—S \qquad (I)$$

in which CD is a primary amine silver halide developing agent, T is a timing group, m is an integer from 0 to 6 and denotes the number of timing groups connected in series, and S is a blocking group.

11. A method as in claim 1, wherein said developing agent is incorporated in said element at a level of 0.1–5 mole per mole of said silver halide.

12. A method as in claim 1, wherein said processing solution is alkaline.

13. A method as in claim 1, wherein said processing solution is in the pH range of 9–12.

14. A method as in claim 1, wherein said processing solution has a viscosity less than 50 cP.

15. A method as in claim 1, wherein said processing solution has a viscosity less than 10 cP.

16. A method as in claim 1, wherein said processing solution comprises a dinucleophile.

17. A method as in claim 1, wherein said processing solution comprises hydrogen peroxide or a compound that releases hydrogen peroxide.

18. A method as in claim 1, wherein said processing solution comprises hydroxyl amine or hydroxyl amine derivative.

19. A method as in claim 1, wherein said hydrophilic binder comprises gelatin.

20. A method as in claim 1, wherein said element further comprises one or more contiguous overcoat layers devoid of silver halide and devoid of developing agent wherein said overcoat layers comprise hydrophilic binder at a level of 3 $g/m^2$ or greater.

21. A method as in claim 20, wherein said overcoat layers comprise hydrophilic binder at a level of at least 10 $g/m^2$.

22. A method as in claim 1, wherein said element is devoid of incorporated base and is devoid of incorporated base-releasing compound.

23. A method as in claim 1, wherein said limiting of said applied volume does not comprise using a cover sheet or using a second dimensionally stable support.

24. A method of forming a chromogenic photographic image comprising the steps of:

providing an aqueous developable photographic element coated on a single dimensionally stable support, wherein said element comprises in reactive association (1) a developing agent, where said developing agent is a precursor of a primary amine, (2) radiation sensitive silver halide, (3) a color coupler compound that forms or releases a dye upon reaction with the oxidation product of a primary amine developing agent, and (4) a hydrophilic binder;

exposing said element to actinic radiation; and developing said image by contacting said element with an applied volume of an aqueous processing solution, wherein the temporal duration of said contacting is limited to a time less than 200% of the time necessary for said element to swell to 90% of the swell volume of said element;

wherein said aqueous developable photographic element is devoid of incorporated base and is devoid of incorporated base-releasing compound;

wherein said precursor of a primary amine has a structure according to formula (I):

$$CD—(T)_m—S \quad (I)$$

in which CD is a primary amine silver halide developing agent, T is a timing group, m is an integer from 0 to 6 and denotes the number of timing groups connected in series, and S is a blocking group;

wherein said aqueous processing solution comprises water and at least one component selected from the group consisting of hydroxide, sulfite, mononucleophiles other than hydroxide and sulfite, dinucleophiles, and mixtures thereof.

25. A method as in claim 24, wherein the temporal duration of said contacting is limited to a time less than 110% of the time necessary for said element to swell to 90% of said swell volume.

26. A method as in claim 24, wherein said silver halide comprises greater than 95 mole percent silver chloride.

27. A method as in claim 24, wherein said primary amine developing agent comprises an aminophenol or a paraphenylenediamine derivative.

28. A method as in claim 24, wherein m in formula (I) is 0, 1, or 2.

29. A method as in claim 24, wherein said precursor is incorporated in said element at a level of 0.1–5 mole per mole of said silver halide.

30. A method as in claim 24, wherein said processing solution is in the pH range of 9–12.

31. A method as in claim 24, wherein said processing solution has a viscosity less than 50 cP.

32. A method as in claim 24, wherein said processing solution has a viscosity less than 10 cP.

33. A method as in claim 24, wherein said processing solution comprises a dinucleophile.

34. A method as in claim 24, wherein said processing solution comprises hydrogen peroxide or a compound that releases hydrogen peroxide.

35. A method as in claim 24, wherein said processing solution comprises hydroxylamine or a hydroxylamine derivative.

36. A method as in claim 24, wherein said hydrophilic binder comprises gelatin.

37. A method as in claim 24, wherein said element further comprises one or more contiguous overcoat layers devoid of silver halide and devoid of developing agent or developing agent precursor wherein said overcoat layers comprise hydrophilic binder at a level of 3 $g/m^2$ or greater.

38. A method as in claim 24, wherein said overcoat layers comprise hydrophilic binder at a level of at least 10 $g/m^2$.

* * * * *